United States Patent [19]

White

[11] Patent Number: 4,623,267

[45] Date of Patent: Nov. 18, 1986

[54] ELASTOMERIC BEARING SYSTEM

[75] Inventor: Larry F. White, Denver, Colo.

[73] Assignee: The Gates Rubber Company, Denver, Colo.

[21] Appl. No.: 571,621

[22] Filed: Jan. 17, 1984

[51] Int. Cl.[4] ..... F16C 27/02

[52] U.S. Cl. ..... 384/125; 384/220

[58] Field of Search ..... 384/125, 907, 97, 98, 384/296, 297, 220

[56] References Cited

U.S. PATENT DOCUMENTS

| | | | |
|---|---|---|---|
| 3,193,335 | 7/1965 | Wing | 384/296 |
| 4,072,309 | 2/1978 | Wilson | 272/136 |
| 4,401,198 | 8/1983 | Kunczynski | 384/125 |
| 4,473,308 | 9/1984 | Kramer | 384/98 |

*Primary Examiner*—Lenard A. Footland

*Attorney, Agent, or Firm*—C. H. Castleman, Jr.; H. W. Oberg, Jr.; Frank P. Grassler

[57] ABSTRACT

A surface of an elastomer mass subject to stress by a force supplying member is protected from abrasion and cracking by interposing a silicone rubber layer between the elastomer mass and force supplying member.

2 Claims, 8 Drawing Figures

ELASTOMERIC BEARING SYSTEM

BACKGROUND OF THE INVENTION

This invention relates to a bearing system for protection of an elastomer mass adapted to be stressed by a force supplying member formed of a material which is harder than the elastomer.

It has been found that when an elastomer mass is compressed against metal, there is a very high stress concentrated in the elastomer near the edges of the interface of the two materials. These stresses are believed to be caused by the relative high coefficient of friction that most elastomers exhibit when they are in contact with a hard surface. This contact in a dynamic application will also cause heat build-up, material degradation, abrasion, cracking and the early failure of the elastomer product.

Lubricating oil will temporarily reduce the coefficient of friction and relieve the lines of extreme stress by spreading the compressive forces over a larger area, but most oils will either attack the surface of the rubber or will be squeezed out and expelled from the interface by the action of compressing the elastomer. The use of lubricating oils is also unacceptable commercially in many applications.

It is an object of this invention to provide a more permanent method of distributing stresses applied to an elastomer mass, and to maintain the integrity of the elastomer at the interface surface and thereby increase its flex life in dynamic applications.

SUMMARY OF THE INVENTION

Briefly described, the invention embraces an elastomeric bearing system for support of an elastomer mass stressed by a force supplying member which is relatively hard compared to the elastomer, comprising the elastomeric mass having a surface subject to stress by the force supplying member, and a layer of silicone rubber positioned substantially against such surface and interposed between the elastomer mass and force supplying member, the silicone rubber layer serving as a bearing to distribute stresses and protect the elastomer mass from abrasion and cracking.

BRIEF DESCRIPTION OF THE DRAWINGS

The invention will be described in part by reference to the accompanying drawings, in which like numerals designate like parts, and in which.

PREFERRED EMBODIMENTS OF THE INVENTION

Figure 1:
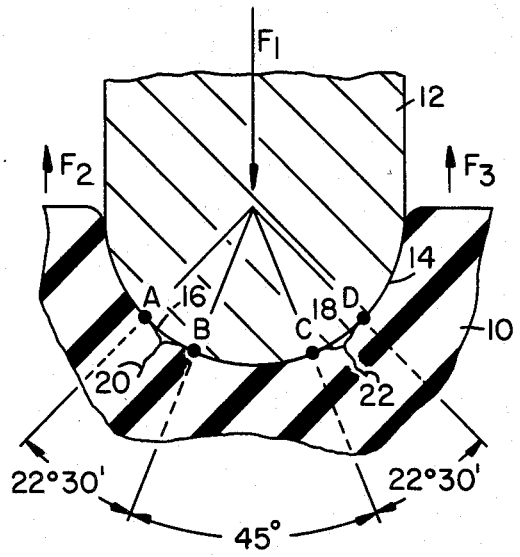
FIG. 1 is a partial sectional view illustrating the resultant abrasion and stress cracking which normally occurs when an elastomer mass is repeatedly stressed by a metal force supplying member, illustrating the problem which the present invention solves.

Referring to FIG. 1, as a result of force $F_1$ elastomer mass 10 is compressed against force supplying member 12 formed of a material harder than the elastomer mass, such as metal or hard plastic. The elastomer mass 10 which may, for instance, be formed of natural or synthetic rubber is provided with a curvilinear bearing surface 14, which may be semi-circular as shown. The portions of the elastomer mass adjacent bearing surface 14 may also be restrained or placed in tension by respective forces $F_2$ and $F_3$.

It has been found that repeated application of force $F_1$ dynamically stressing the elastomer mass 10 causes abrasion at the interface surface 16 and 18 between points A and B and C and D, respectively. It has also been found that stress cracking at 20 and 22 occurs within the same envelope. However, no abrasion or stress cracking occurs substantially within the 45° envelope between points B and C. It has also been found that when increased force is applied by the force supplying member 12, the distance between points B and C remains fixed, however the distances between points A and B and between C and D both increase.

Figure 2:
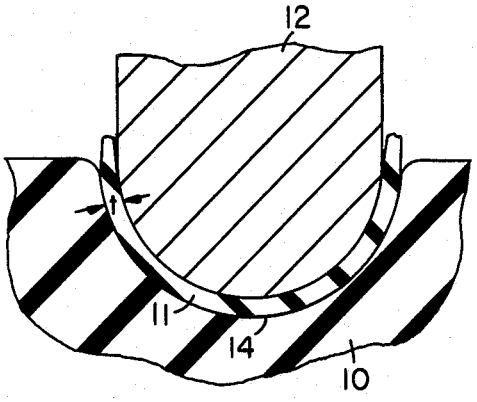
FIG. 2 is a sectional view showing the bearing system of the invention which ameliorates the unacceptable condition shown in FIG. 1.

In accordance with the invention as shown in FIG. 2, a bearing member 11 formed of silicone rubber is interposed between elastomer mass 10 and force supplying member 12. Silicone rubber bearing 11 is preferably of a substantially uniform thickness "t" preferably exceeding about 0.080 inches. This relatively thin layer of silicone rubber interposed between the hard material of the force supplying member, particularly metal, and the relatively soft elastomer e.g., rubber material of mass 10 is believed to reduce the relative coefficient of friction between the materials with the silicone rubber layer providing lubricity. The silicone rubber layer acts a bearing in that it relieves and spreads the forces that would otherwise tend to destroy the elastomer mass 10 as previously discussed in respect to FIG. 1. Many different materials were tested for layer 11, however only silicone rubber was found to be effective.

Although not narrowly critical, it is highly preferred that the elastomer mass 10 and silicone rubber layer 11 be free from permanent mutual attachment such as by bonding. This allows for relative movement between the parts when stressed by the force supplying member, and aids in distributing the forces and preventing the stress concentrations which result otherwise in the abrasion and stress cracking shown in FIG. 1.

Figure 3:
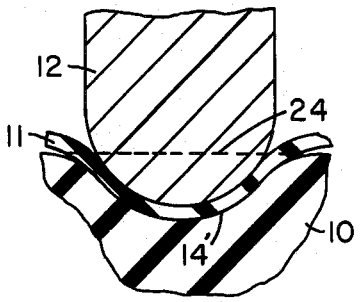
FIG. 3 shows a variation of the bearing system of FIG. 2.

Although it is preferred that the elastomer mass 10 have a curvilinear bearing surface 14, which may be preformed by molding, extrusion, milling or the like, as shown in FIG. 3 the bearing surface 14' (shown in the stressed condition) may, in the unloaded condition be non-curvilinear as shown in phantom at 24.

The bearing system of the invention will have various applications which will be appreciated by those of ordinary skill in the art. For instance, the bearing system of the invention is applicable to rubber motor mounts which are continually flexed in use. The silicone layer would be interposed between the engine and the rubber mount and/or between the mount and frame where it is attached.

Figure 6:
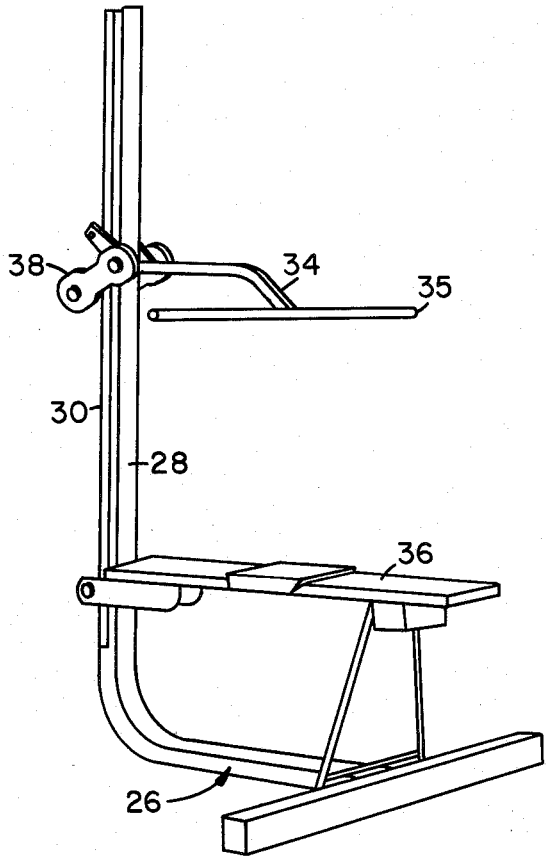
FIG. 6 is a perspective view of an exercise apparatus utilizing the tension straps of FIG. 4.
Figure 7:
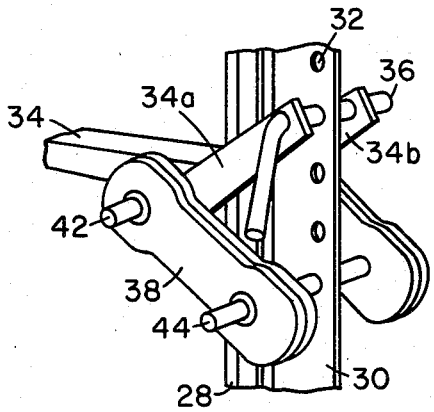
FIG. 7 is a partial perspective rearward view of the tension strap connection shown in FIG. 6.

Another application for the bearing system of the invention is as a tension strap ("tension biasing means") in an exercise or other device, such as the exercise apparatus shown in U.S. Pat. No. 4,072,309 to Wilson. These devices previously used aircraft shock cords as the tension biasing means, which had certain drawbacks. Such a device is represented in FIGS. 6 and 7 and includes a T-shaped base frame 26 from which a vertical rail 28 extends upwardly. Rail 28 has flange 30 carrying a series of vertically oriented bores 32 for pivotally attaching an exercise lever arm 34, and a bench 36, both adjustably attached to the rail 30.

As shown best in FIG. 7, lever arm 34 is pivotally connected to rail 30 through integral (e.g., welded) side fingers 34*a* and 34*b* which straddle the vertical support 28 and are joined thereto by pin 36 which links fingers 34*a* and 34*b* through a selected bore 32.

Two pairs of tension straps 38 of the invention link lever arm 34 with upright rail 28 and provide a resistive or biasing force when an exerciser attempts to press the handle 35 of the lever arm in a direction tending to elongate the rubber tension strap 38 i.e., upwardly in the arrangement of FIGS. 6 and 7. The tension straps 38 have spaced bores 40, as shown in FIG. 4, which are slidably mounted respectively on pin 42, attached to fingers 34*a* and 34*b*, and pin 44 penetrating a selected bore 32 in flange 30 of the upright rail.

Figure 4:
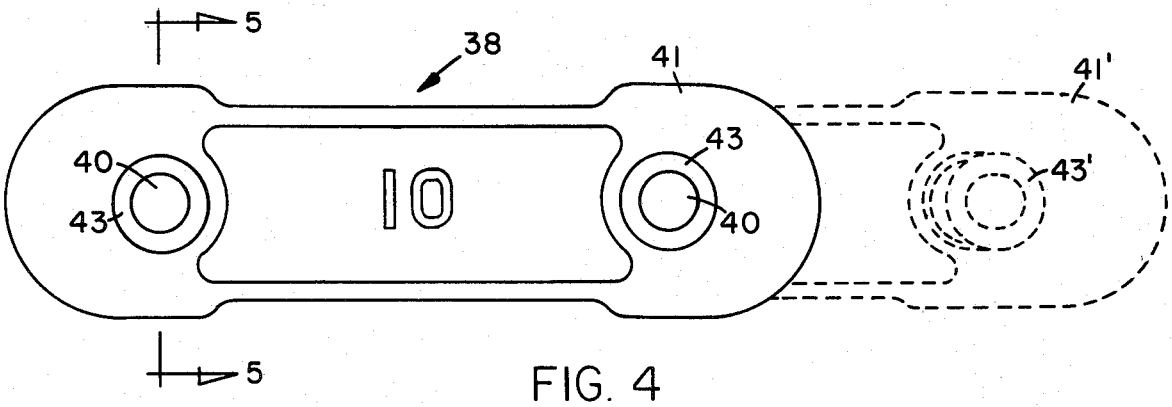
FIG. 4 is a side view of a molded tension strap formed in accordance with the invention, and also shown in the stressed position (in phantom)
Figure 5:
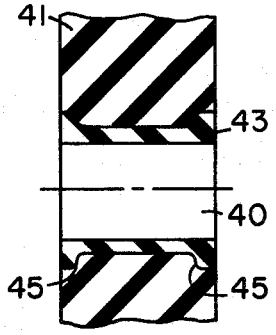
FIG. 5 is an elevational sectional view of the bearing system taken along section 5—5 of FIG. 4.

As seen best in FIGS. 4 and 5, the tension strap of the invention is formed of an elongated elastomer mass 41, molded of a high elasticity elastomer such as natural rubber, in which silicone, rubber bearings 43 of spool shape are mounted adjacent bores 40. The silicone rubber bearings 43 have been separately molded and inserted subsequently into the bores 40, without bonding or covulcanizing the bearing and molded rubber strap 41 together. In this manner, when the strap is stressed such as by pressing handle 35 upwardly in FIG. 6, the strap is stretched to a position such as shown in phantom of FIG. 4 with portions of rubber mass 41' being compressed and other portions being placed in tension. Portions of rubber mass 41' may have sliding movement relative to silicone bearing 43' at the mutual interface therebetween. In effect, referring back to FIG. 1, the apparent lubricity afforded by the silicone bearing allows a virtually unimpeded movement between the parts along the mutual interface, particularly between points A and B and between points C and D where stresses and abrasion would be at a maximum in the elastomer mass but for the presence of the interposed silicone rubber layer.

The spool design shown in FIG. 5 is preferred since the flange portions 45 register with and are retained by mating molded recesses in elastomer mass 41, as shown in FIG. 5.

The straps 38 may carry an imprinted designation thereon to signify the effective resistive force rating of the strap at full extension. The resistive force can obviously be varied by material selection e.g., modulus change, by changing the material thickness, by the number of straps used, and the like.

Figure 8:
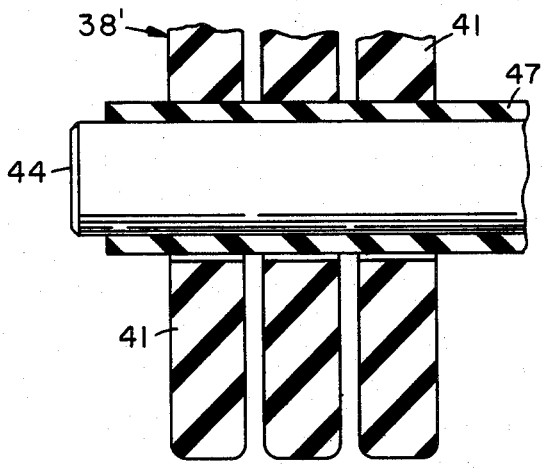
FIG. 8 is a partial elevational sectional view of an alternative embodiment of the invention.

An alternative is shown in FIG. 8 in which the tension straps 38', three of which are shown adjacently attached to pin 44, are joined thereto through an interposed sleeve of silicone rubber extrusion or molding 47. In this embodiment sleeve 47 may first be installed over pin 44 and the desired number of tension straps 38' which have a straight bore therein without any other bearing, are mounted directly over the sleeved pin.

The tension straps 38 of the invention have been tested according to a dynamic test in which lever arm 34 of the apparatus of FIG. 6 is repeatedly raised and lowered whereby the strap 38 is elongated from a no load center distance of about 6 inches between bores 40, to a center distance of about 11½ inches. With the tension strap of FIG. 4 of the invention, with bearing 43 having a minimum wall thickness of 0.095 inches, an average of 50,000 to 70,000 cycles are obtained before a stress crack of 9/16 inch is induced in the elastomer mass. In comparison, employing the same test using an identical tension strap with the exception that silicone rubber bearing 43 is omitted (and replaced with natural rubber integrally molded with the remainder of mass 41), this control strap yielded on the average approximately 7500 cycles before a 9/16 inch crack was induced.

While certain representative embodiments and details have been shown for the purpose of illustrating the invention, it will be apparent to those skilled in this art that various changes and modifications may be made therein without departing from the spirit or scope of the invention.

What is claimed is:

1. A tension biasing means adapted to be stressed by a force supplying member which is relatively hard compared to the elastomeric material forming the tension biasing means, comprising: An elongated elastomeric mass, a pair of spaced bores penetrating the elastomeric mass and adapted to receive the force supplying member within the bores, and a layer of silicone rubber positioned against the inner surface of the bores adapted to be interposed between the elastomer mass and force supplying member, the silcone rubber layer serving as a bearing to distribute stresses and protect the elastomeric mass from abrasion and cracking, and wherein the silicone rubber bearing is provided with flanges which matingly engage corresponding recesses in the elastomer mass for self-retention therewith.

2. An exercise apparatus having a frame, a lever arm force supplying member, and a tension strap connecting the level arm to the frame and adapted to be stretched in use, the tension strap being formed of a tension biasing means formed predominantly of high elasticity elastomeric material adapted to be stressed by the force supplying member which is relatively hard compared to the elastomeric material forming the tension biasing means, adapted and arranged so that in operation of the apparatus portions of the tension biasing means are placed in compression while other portions of the tension biasing means are placed in tension, the tension biasing means comprising: An elongated elastomeric mass, a pair of spaced bores penetrating the elastomeric mass and adapted to receive the force supplying member within the bores, said bores having separate axes, and a layer of silicone rubber, separate and distinct from the elastomeric mass, positioned against the inner surface of the bores and interposed between the elastomer mass and force supplying member, the silicone rubber layer serving as a bearing to distribute stresses and protect the elastomeric mass from abrasion and cracking.

* * * * *